US010077642B2

(12) United States Patent
Elmer

(10) Patent No.: US 10,077,642 B2
(45) Date of Patent: Sep. 18, 2018

(54) GAS COMPRESSION SYSTEM FOR WELLBORE INJECTION, AND METHOD FOR OPTIMIZING GAS INJECTION

(71) Applicant: Encline Artificial Lift Technologies LLC, Houston, TX (US)

(72) Inventor: William G. Elmer, Tyler, TX (US)

(73) Assignee: Encline Artificial Lift Technologies LLC, Houston, TX (US)

( * ) Notice: Subject to any disclaimer, the term of this patent is extended or adjusted under 35 U.S.C. 154(b) by 262 days.

(21) Appl. No.: 15/186,443

(22) Filed: Jun. 18, 2016

(65) Prior Publication Data

US 2017/0051588 A1 Feb. 23, 2017

Related U.S. Application Data

(60) Provisional application No. 62/207,038, filed on Aug. 19, 2015.

(51) Int. Cl.
*E21B 43/12* (2006.01)
*E21B 47/06* (2012.01)
*E21B 41/00* (2006.01)

(52) U.S. Cl.
CPC ..... *E21B 43/122* (2013.01); *E21B 41/0092* (2013.01); *E21B 47/06* (2013.01)

(58) Field of Classification Search
CPC ..... E21B 43/12; E21B 43/121; E21B 43/122; E21B 47/0007; E21B 47/06; E21B 41/0092; E21B 44/00
See application file for complete search history.

(56) References Cited

U.S. PATENT DOCUMENTS 3,863,714 A 2/1975 Watson, Jr.
4,052,885 A * 10/1977 Shuck ..... E21B 49/008 73/38
4,150,721 A * 4/1979 Norwood ..... E21B 43/00 137/625.64

(Continued)

OTHER PUBLICATIONS

Boswell et al.; Controlling Liquid Load-Up with "Continuous Gas Circulation"; Society of Petroleum Engineers; 1997, SPE 37426, pp. 325-332.

(Continued)

*Primary Examiner* — Jennifer H Gay
(74) *Attorney, Agent, or Firm* — Peter L. Brewer; Thrive IP

(57) ABSTRACT

A gas compression optimization system and a method for optimizing gas injection rate in support of a gas lift operation. The optimization system is designed to control a rate of gas injection in connection with a gas lift system in a wellbore. The system includes a string of production tubing, and an annular region around the production tubing. The system also comprises a production line at the surface. The system further includes a pressure transducer that is configured to determine a differential pressure across an orifice plate placed along the production line. The system additionally includes a gas injection line. The gas injection line is at the surface, and is configured to inject a compressible fluid into the annular region. The system additionally includes a controller which is configured to control the injection of the compressible fluid into the annular region in response to differential pressure signals.

39 Claims, 5 Drawing Sheets

(56) References Cited

U.S. PATENT DOCUMENTS 4,226,284 A 10/1980 Evans
4,352,376 A * 10/1982 Norwood ..... E21B 34/16 137/552.7
4,509,599 A 4/1985 Chenoweth et al.
4,703,664 A * 11/1987 Kirkpatrick ..... E21B 21/001 73/152.21
5,006,046 A 4/1991 Buckman et al.
5,132,904 A * 7/1992 Lamp ..... E21B 34/16 166/53
RE34,111 E * 10/1992 Wynn ..... E21B 43/121 166/105
5,636,693 A * 6/1997 Elmer ..... E21B 43/121 166/370
5,735,346 A * 4/1998 Brewer ..... E21B 43/122 166/250.03
5,785,123 A * 7/1998 Lea, Jr. ..... E21B 43/121 137/624.15
5,819,848 A * 10/1998 Rasmuson ..... E21B 47/0007 166/250.15
5,826,659 A 10/1998 Hershberger
5,878,817 A * 3/1999 Stastka ..... E21B 43/121 166/372
5,904,209 A 5/1999 Kenworthy et al.
5,937,946 A * 8/1999 Streetman ..... E21B 43/34 166/267
5,941,305 A * 8/1999 Thrasher ..... E21B 43/121 166/53
5,957,199 A 9/1999 McLean et al.
5,957,200 A * 9/1999 Majek ..... E21B 34/16 137/624.15
5,983,164 A * 11/1999 Ocondi ..... E21B 43/12 702/12
5,996,691 A 12/1999 Norris et al.
6,196,324 B1 3/2001 Giacomino et al.
6,209,642 B1 * 4/2001 Streetman ..... E21B 34/16 166/267
6,241,014 B1 * 6/2001 Majek ..... E21B 43/121 166/372
6,293,341 B1 * 9/2001 Lemetayer ..... E21B 43/122 166/250.15
6,536,522 B2 * 3/2003 Birckhead ..... E21B 43/121 166/250.01
6,585,050 B1 7/2003 Etzkorn
6,595,287 B2 7/2003 Fisher
6,595,294 B1 * 7/2003 Dalsmo ..... E21B 43/122 166/250.01
6,672,392 B2 * 1/2004 Reitz ..... E21B 43/121 166/372
6,883,606 B2 4/2005 Evans et al.
7,000,693 B2 2/2006 Powell
7,114,557 B2 * 10/2006 Cudmore ..... E21B 43/121 166/52
7,389,684 B2 * 6/2008 Roy ..... E21B 43/122 73/152.29
7,428,929 B2 9/2008 Sherwood et al.
7,464,753 B2 12/2008 White et al.
7,490,675 B2 2/2009 Hearn
7,610,955 B2 11/2009 Irwin, Jr.
7,784,548 B2 8/2010 Wilson et al.
7,806,188 B2 10/2010 Hearn
7,963,326 B2 6/2011 Giacomino
8,113,288 B2 2/2012 Bachtell et al.
8,281,853 B1 * 10/2012 Hill ..... E21B 47/042 166/250.03
8,408,306 B2 4/2013 Arizmendi, Jr. et al.
8,421,251 B2 4/2013 Pabon et al.
9,297,238 B2 3/2016 Scantlebury et al.
9,297,247 B2 3/2016 Lea, Jr.
9,951,601 B2 * 4/2018 Rashid ..... E21B 47/0007
2002/0074118 A1 * 6/2002 Fisher ..... E21B 43/12 166/250.15
2003/0145986 A1 * 8/2003 Evans ..... E21B 43/121 166/250.15
2004/0060705 A1 4/2004 Kelley
2004/0123987 A1 * 7/2004 Reitz ..... E21B 43/121 166/370
2007/0012442 A1 * 1/2007 Hearn ..... E21B 43/121 166/250.15
2007/0275471 A1 * 11/2007 Coward ..... E21B 43/00 436/55
2007/0276542 A1 * 11/2007 Coward ..... E21B 43/00 700/273
2009/0266554 A1 * 10/2009 Wilson ..... E21B 43/122 166/372
2010/0276160 A1 * 11/2010 Tolman ..... E21B 33/10 166/386
2011/0168413 A1 * 7/2011 Bachtell ..... E21B 43/122 166/401
2015/0027693 A1 * 1/2015 Edwards ..... E21B 43/14 166/250.03
2016/0053753 A1 * 2/2016 Rashid ..... E21B 43/121 700/282
2017/0051588 A1 * 2/2017 Elmer ..... E21B 43/122
2017/0356278 A1 * 12/2017 Nandola ..... E21B 43/128
2018/0016880 A1 * 1/2018 Elmer ..... E21B 43/122

OTHER PUBLICATIONS

Turner et al.; Analysis and Prediction of Minimum Flow Rate for the Continuous Removal of Liquids from Gas Wells; Journal of Petroleum Technology vol. 246; Nov. 1969, pp. 1475-1482.
William G. Elmer; Batch Pumping: A New Method to Solve Downhole Liquid Holdup; Society of Petroleum Engineers, SPE 119377, 2009, pp. 1-7.
Ali et al.; Investigation of New Tool to Unload Liquids from Stripper-Gas Wells; Society of Petroleum Engineers; 2003, SPE 84136, pp. 1-12.
Elmer et al.; New Single Well Standalone Gas Lift Process Facilitates Barnett Shale Fracture Treatment Flowback; Society of Petroleum Engineers; 2009, SPE 118876, pp. 1-8.
Armenta et al.; Operating Dual-Completed Well to Increase Gas Recovery in Low Productivity Gas Reservoirs with Water Production Problems; Petroleum Society, 2004; 2004-172; pp. 1-15.
William G. Elmer; Tubing Flowrate Controller: Maximize Gas Well Production from Start to Finish; Society of Petroleum Engineers; 1995, SPE 30680, pp. 97-106.
Luan et al.; A New Model for the Accurate Prediction of Liquid Loading in Low-Pressure Gas Wells; Nov. 2012 Journal of Canadian Petroleum Technology; pp. 493-498.
Lane et al.; Consideration for Optimizing Artificial Lift in Unconventionals; Unconventional Resources Technology Conference; URTeC 1921823 2014, pp. 1-11.
Bill Lane, The Case for Intelligent Artificial Lift; upstreampumping.com; 2016.

* cited by examiner

GAS COMPRESSION SYSTEM FOR WELLBORE INJECTION, AND METHOD FOR OPTIMIZING GAS INJECTION

CROSS REFERENCE TO RELATED APPLICATIONS

This application claims the benefit of U.S. Provisional Ser. No. 62/207,038 filed Aug. 18, 2015. That application is entitled "Gas Compression System for Wellbore Injection, and Method for Optimizing Gas Injection," and is incorporated herein in its entirety by reference

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of hydrocarbon recovery operations. More specifically, the present invention relates to a gas compression system to support artificial lift for a wellbore, and methods for optimizing the injection of compressible fluids into a well to assist the lift of production fluids to the surface. The invention also relates to real time critical flow optimization for a wellbore.

TECHNOLOGY IN THE FIELD OF THE INVENTION

In the drilling of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing.

In completing a wellbore, it is common for the drilling company to place a series of casing strings having progressively smaller outer diameters into the wellbore. These include a string of surface casing, at least one intermediate string of casing, and a production casing. The process of drilling and then cementing progressively smaller strings of casing is repeated until the well has reached total depth. In some instances, the final string of casing is a liner, that is, a string of casing that is not tied back to the surface. The final string of casing, referred to as a production casing, is also typically cemented into place.

To prepare the wellbore for the production of hydrocarbon fluids, a string of tubing is run into the casing. A packer is optionally set at a lower end of the tubing to seal an annular area formed between the tubing and the surrounding strings of casing. The tubing then becomes a string of production pipe through which hydrocarbon fluids may be lifted.

Some wellbores are completed primarily for the production of gas (or compressible hydrocarbon fluids), as opposed to oil. Other wellbores initially produce hydrocarbon fluids, but over time transition to the production of gases. In either of such wellbores, the formation will frequently produce fluids in both gas and liquid phases. Liquids may include water, oil and condensate. At the beginning of production, the formation pressure is typically capable of driving the liquids with the gas up the wellbore and to the surface. Liquid fluids will travel up to the surface with the gas primarily in the form of entrained droplets.

During the life of the well, the natural reservoir pressure will decrease as gases and liquids are removed from the formation. As the natural downhole pressure of the well decreases, the gas velocity moving up the well drops below a so-called critical flow velocity. See G. Luan and S. He, *A New Model for the Accurate Prediction of Liquid Loading in Low-Pressure Gas Wells*, Journal of Canadian Petroleum Technology, p. 493 (November 2012) for a recent discussion of mathematical models used for determining a critical gas velocity in a wellbore. In addition, the hydrostatic head of fluids in the wellbore will work against the formation pressure and block the flow of in situ gas into the wellbore. The result is that formation pressure is no longer able, on its own, to produce fluids from the well in commercially viable quantities.

In response, various remedial measures have been taken by operators. For example, operators have sought to monitor tubing pressure through the use of pressure gauges and orifice plates at the surface. U.S. Pat. No. 5,636,693 entitled "Gas Well Tubing Flow Rate Control," issued in 1997, disclosed the use of an orifice plate and a differential pressure controller at the surface for managing natural wellbore flow up more than one flow conduit. The '693 patent is incorporated herein in its entirety by reference.

U.S. Pat. No. 7,490,675, entitled "Methods and Apparatus for Optimizing Well Production," also proposed the use of an orifice plate and a differential pressure controller at the surface, but in the context of a plunger lift system. That patent issued in 2009.

Operators have sometimes sought to enhance the production of gas by replacing the original production tubing with a smaller-diameter string. A packer may be placed at the bottom of the new production sting to force the movement of gas to the surface through the smaller orifice. The smaller-diameter string creates a restricted flow path at the bottom of the wellbore, increasing pressure and aiding the flow of hydrocarbons to the surface.

A common technique for artificial lift in both oil and gas wells remains the gas lift system. Gas lift refers to a process wherein a gas (typically methane, ethane, propane, nitrogen and related produced gas combinations) is injected into the wellbore downhole to reduce the density of the fluid column. Injection is done through so-called gas lift valves stacked vertically along the production tubing. The injection of gas through the valves and into the production tubing decreases the backpressure against the formation.

Gas lift has been popular for lifting oil wells, especially in large fields or offshore facilities, as the power station may be remotely located from the wells. However, gas lift has a disadvantage relative to mechanical artificial lift processes in that it is generally unable to reduce flowing bottom hole pressure to a desired level prior to abandoning reservoirs. Gas lift also suffers from the inability to control injection rates in substantially real time. In this respect, a gas lift system injects gas continuously and at the same rate regardless of fluctuations in fluid density within the wellbore. As a result, other forms of artificial lift (primarily rod pumping and plunger lift) continue to be preferred for oil wells.

In 1997, the concept of "Continuous Gas Circulation" (CGC) was introduced as a form of gas lift. See J. T. Boswell and J. D. Hacksma, *Controlling Liquid Load-Up with 'Continuous Gas Circulation'*, SPE No. 37426 (1997). In this version of gas lift, the velocity of gas is elevated to the point that it exceeds the critical velocity required for continuous liquid removal. This is as opposed to conventional gas lift where the existing ratio of gas-to-liquids (GOR) is artificially (and somewhat arbitrarily) elevated to affect a reduction in flowing bottom hole pressure, but without regard to critical velocity. Some in the industry have referred to the concept of continuous, critical-flow gas lift as "Poor-Boy Gaslift" as it typically operates without the benefit of gas lift valves, meaning that gas is injected into the wellbore at a continuous high rate all the way down to the bottom of the production tubing.

The application of CGC has allowed flowing bottom hole pressures to be significantly below those normally associated with regular gas lift. This has remedied gas lift's problem of reaching a low enough well abandonment pressure. At the same time, CGC is highly inefficient as the on-site compressors run continuously and at the same rate without concern for actual critical flow needs in the production tubing. This is so even though the concept of critical flow has been known for some time. See R. G. Turner, M. G. Hubbard and A. E. Dukler, *Analysis and Prediction of Minimum Flow Rate for the Continuous Removal of Liquids from Gas Wells*, Journal of Petroleum Technology, p. 1475 (November 1969).

Accordingly, a system and method are needed that allow injection gas flow rates to be adjusted in substantially real time so that well flow will remain just above the "critical rate" needed to continuously remove fluid. A need further exists to pair a specially-configured electronic gas flow rate processor with a control valve or an on-site compressor to adjust gas flowrates to a well operator's desired set point based on measured differential pressure at the well head.

BRIEF SUMMARY OF THE INVENTION

A gas compression optimization system is first provided herein. The gas compression optimization system is designed to operate at a well site. In one aspect, the optimization system is designed to control a rate of gas injection in connection with a gas lift system in a wellbore.

The gas compression optimization system first includes a string of production tubing. The tubing string resides within a wellbore. The tubing string extends from a surface, down to a selected subsurface formation. The tubing string may or may not have gas lift valves.

The system also includes an annular region. The annular region resides around the tubing string, and also extends down into the wellbore and to the subsurface formation.

The system also comprises a production line at the surface. The production line is in selected fluid communication with the tubing string.

The system further includes a pressure transducer. The pressure transducer is configured to determine a differential pressure across an orifice plate. Preferably, the orifice plate resides along the production line at or near the surface.

The system additionally includes a gas injection line. The gas injection line is also at or near the surface, and is configured to inject a compressible fluid into the annular region, that is, the back side of the tubing.

The system additionally includes a controller. The controller is configured to control the injection of the compressible fluid into the annular region. This serves to maintain fluid flow in the production tubing during production at (or just above) a critical gas flow rate. Preferably, the controller is a specially-configured micro-processor that operates to maintain fluid flow into the annular region proximate or just above a pre-selected differential pressure set point. More specifically, the controller maintains fluid flow in the production tubing at or above a critical gas velocity in substantially real time, wherein critical gas velocity is correlated to the differential pressure set point.

In operation, differential pressure measurements are periodically taken across the orifice plate. These "DP" measurements are then compared to the pre-determined set point. The set point may be a specific value, or it may be a so-called dead band representing an acceptable range around the set point. The controller reduces the rate of injection when fluids flowing through the tubing string exceed the differential pressure set point as indicated by pressure readings, and increases the rate of injection when fluids flowing through the production tubing fall below the differential pressure set point as also indicated by differential pressure readings.

In one aspect, the gas compression optimization system further comprises a compressor. The compressor is configured to pump the incompressible fluid into the gas injection line. The compressor may be a dedicated variable speed compressor that resides at a well site for the wellbore. In this instance, the controller is configured to send command signals to the compressor to adjust an operational speed to control the injection of the compressible fluid near the differential pressure set point. In another aspect, the compressor is a facilities compressor that resides remote from a well site for the wellbore and is configured to deliver gas to a plurality of high pressure gas injection lines. In this instance, the system further comprises a control valve, with the controller being configured to send command signals to the control valve to adjust a flow of fluids through the gas injection line to control the injection of the compressible fluid near the differential pressure set point. In either instance, the injection rate of compressible fluids is optimized.

A method of optimizing gas injection rate is also provided herein. The method uses a gas compression optimization system for a wellbore. The method employs the gas compression system as described above, in its various embodiments. Preferably, the gas compression optimization system is associated with a wellbore that is horizontally completed to overcome a problem of slug flow.

The method first includes providing a wellbore. The wellbore has been formed for the purpose of producing hydrocarbon fluids to the surface in commercially viable quantities. Preferably, the well primarily produces hydrocarbon fluids that are compressible at surface conditions, e.g., methane, ethane, propane and/or butane.

The method next includes associating a gas compressor with the wellbore. The gas compressor may be an on-site compressor. Alternatively, the gas compressor may be a remote compressor that supplies gas to a plurality of wells in a field through a high pressure gas pipeline. In either instance, the gas compressor is associated with the wellbore through a gas injection line.

The method also includes producing hydrocarbon fluids through a production tubing in the wellbore, up to the surface, and into a production line. An annular region is formed between the production tubing and a surrounding casing string.

The method next comprises determining a critical flow velocity for gas production in the production tubing. This is the flow velocity for gas needed to carry entrained liquid particles to the surface based upon production tubing diameter. Optionally, the method also includes determining a set point for gas injection. The set point represents a point at which a rate of gas injection is adjusted in order to maintain the desired critical flow velocity. The set point is a pressure differential (or Differential Pressure, or "DP") value, and preferably takes into account the inner diameter of the production tubing.

The method additionally includes determining the DP at an orifice plate along the production line. Preferably, the step of determining DP includes determining whether the pressure differential is within a designated dead band. For readings within the dead band, no gas injection flow rate adjustments are made.

The method also includes adjusting a rate of gas injection into the annular region to ensure that critical flow velocity is achieved in the production tubing. If an on-site compressor is used, then the step will include adjusting the compressor speed. This may include increasing the compressor speed when the measured DP less the desired DP set point is below a DP dead band, or reducing the compressor speed when the measured DP less the desired DP set point is above a DP dead band. Of interest, where the speed falls below a minimum operating speed of the compressor, then the method will further include the step of bypassing the compressor to keep the compressor running at a minimum RPM speed without increasing output pressure. If a remote, central compressor is used, then the step will include choking gas (or, alternatively, reducing the choke for gas) being delivered to the wellbore along a gas injection line.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1A:
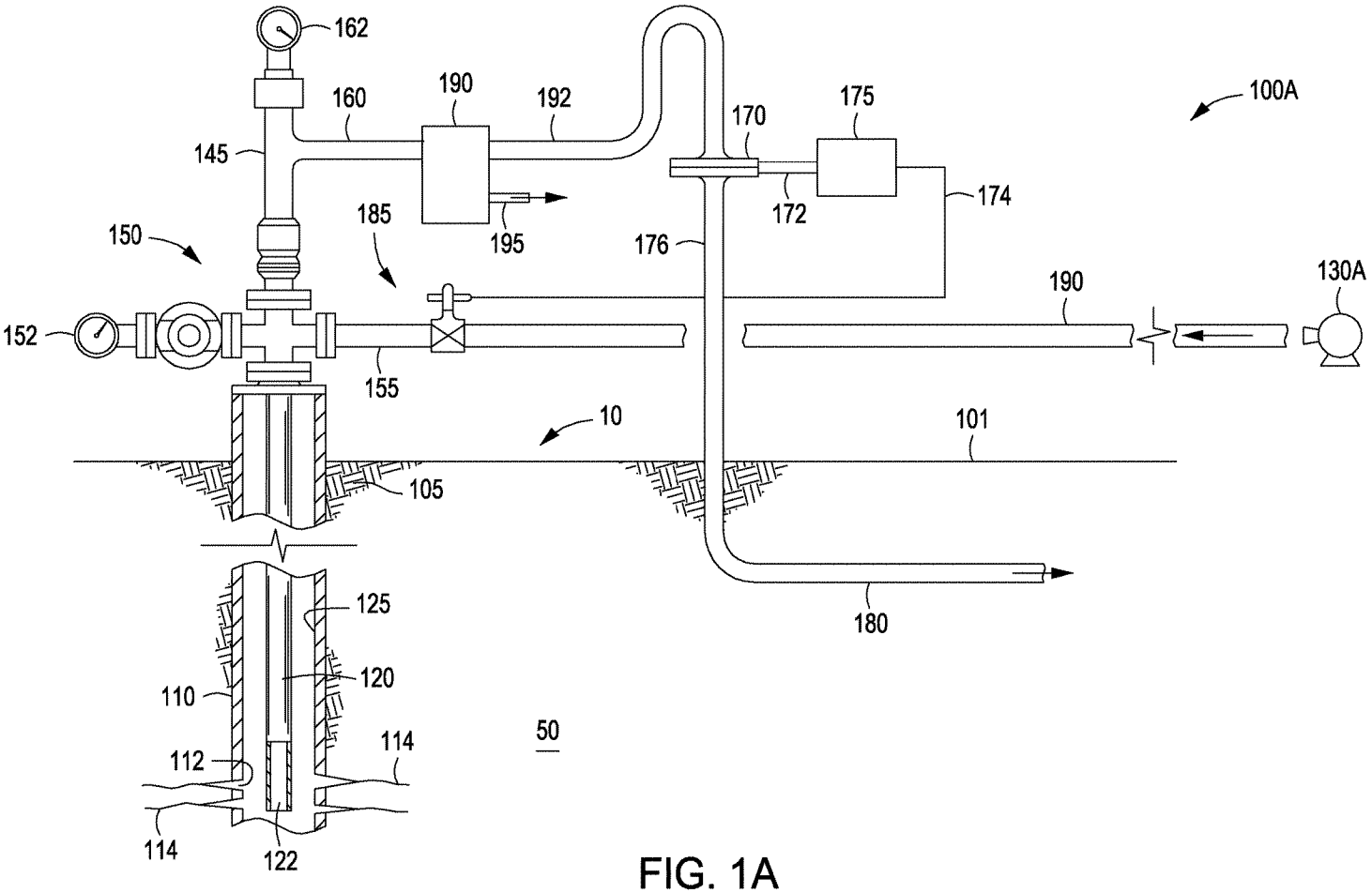
FIG. 1A is a schematic illustration of a gas compression optimization system for a wellbore, in one embodiment. The gas compression optimization system controls a rate at which gas is injected into the annular region of a wellbore to support gas lift. In this arrangement, gas injection is supplied by a remote gas compressor.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, oxygen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "wellbore fluids" means water, hydrocarbon fluids, formation fluids, or any other fluids that may be within a wellbore during a production operation.

As used herein, the term "gas" refers to a fluid that is in its vapor phase.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore." The term "bore" refers to the diametric opening formed in the subsurface by the drilling process.

Description of Selected Specific Embodiments

FIG. 1A is a schematic illustration of a gas compression optimization system 100A, in one embodiment. The gas compression optimization system 100A exists for the purpose of providing gas lift in connection with the production of hydrocarbon fluids from a wellbore 10. In one aspect, the wellbore 10 produces primarily gas, with diminishing liquid production. In one aspect, produced fluids may have a GOR in excess of 500 or, more preferably, above 3,000.

The wellbore 10 defines a bore that is formed in an earth surface 105, and down to a selected subsurface formation 50. The wellbore 10 includes at least one string of casing 110 which extends from an earth surface 101 and down proximate the subsurface formation 50. In one aspect, the casing 110 represents a string of surface casing, one or more intermediate casing strings, and a string of production casing. For illustrative purposes, only one casing string 110 is presented.

In the view of FIG. 1A, the wellbore 10 is shown as having been completed in a vertical orientation. However, it is understood that the gas compression optimization system 100A may be utilized in connection with a wellbore that has been completed in a horizontal (or other deviated) orientation. As will be realized from the discussion below, the optimization system (100A or 100B) is ideally suited for wells that have been completed horizontally.

In FIG. 1A, it is seen that the casing 110 has been perforated. Perforations are shown at 112. In addition, the formation 50 has been fractured. Illustrative fractures are presented at 114. Preferably, the casing 110 extends down to a lower end of the subsurface formation 50, and the perforations 112 are placed proximate that lower end. In another aspect, the casing 110 has an elongated horizontal portion (not shown) with openings being provided in the casing 110 through perforating or jetting along stages of the horizontal portion within the subsurface formation 50. Of course, it is understood that the current inventions are not limited by the manner in which the casing string 110 is oriented or perforated unless expressly so stated in the claims.

The wellbore 10 has received a string of production tubing 120. The production tubing 120 extends from a well head 150 at the surface 101, down proximate the subsurface formation 50. An annular region 125 is provided between the tubing string 120 and the surrounding casing string 110. Optionally, a packer (not shown) is placed at a lower end of the tubing string 120 to seal the annular region 125.

The gas compression optimization system 100 is designed to inject a compressible fluid into the annular region 125 of the wellbore 10. The compressible fluid may be a light hydrocarbon gas, such as methane, ethane, propane, or combinations thereof. Alternatively or in addition, the compressible fluid may be nitrogen, argon or oxygen. The present inventions are not limited to the type of gas injected unless expressly stated in the claims. The gas is injected in support of a gas lift system for the wellbore 10. In one aspect, the injected compressible fluid is composed primarily of produced gases.

The compressible fluid is injected through an injection line 155 and into the annular region 125. In one aspect, gas lift valves (not shown) are placed along the production tubing 120 to facilitate injection. In another aspect, gas is injected through one or more orifices, or check valves (not shown), placed at a lower end of the production tubing 120. In still another aspect, gas is injected through a dedicated tubing, or is simply injected into the tubing-casing annulus 125 where it flows down to the perforations 112 and back up the production tubing 120 with produced fluids. Where the production tubing 120 has a packer, a tube or valve may be provided along the packer (not shown) to facilitate annular injection below the production tubing 120. For purposes of the present disclosure, the term "annular region" includes a dedicated flow line that extends down proximate the subsurface region.

To facilitate injection into the annular region 125, the gas compression optimization system 100A includes a gas compressor 130A. In the arrangement of FIG. 1A, the compressor 130A is remote from the wellbore 10 and serves as a central compressor for multiple high-pressure gas lines. Illustrative gas line 135 delivers gas to injection line 155 to service the well site for wellbore 10.

In order to control a rate at which gas is injected from line 155 and into the annular region 125, a control valve 185 is provided. In the arrangement of FIG. 1A, the control valve 185 is placed along the injection line 155. However, the control valve 185 may alternatively be placed at the well head 150 or adjacent the compressor 130A which, for purposes of the present disclosure and claims, is intended to be the same. The control valve 185 may be, for example, a high pressure motor valve.

The control valve 185 is controlled by a specially-configured controller 175. The controller 175 may be either a pneumatic or electronic pressure differential micro-processor. The control function of the controller 175 will be described in greater detail, below.

In U.S. Pat. No. 5,636,693, a method was described for controlling the flow of gas at the critical flow rate. This was done by measuring a differential pressure resulting from flow across an orifice plate, and allowing gas in excess of this rate to be produced up another flow conduit, which was a second tubing string or the tubing-casing annulus. FIG. 1A is similar to the embodiment presented in the '693 patent. In this respect, a line 145 is seen extending from the well head 150. A first pressure gauge 162 is shown measuring pressure in line 145.

Line 160 tees from line 145 and optionally delivers production fluids to a separator 190. The optional separator 190 generates at least two fluid streams—a liquid stream 195 comprising water, oil and/or condensate, and a gas stream 192. Liquids in the liquid stream 195 may optionally be processed, with water being captured for disposal or re-injection, and any hydrocarbons being harvested for further downstream processing or sale. The gas stream 192 represents a production line that delivers light hydrocarbons comprising primarily methane, ethane, propane and, perhaps, impurities such as oxygen, nitrogen and hydrogen sulfide.

An orifice plate 170 is placed along the gas stream 192. Differential pressure above and below the orifice plate 170 is recorded through line 172, and processed by the controller 175. The controller 175 may be an embedded programmable logic controller (or "PLC"). The PLC may be, for example, the FMD88-10 PLC which offers an open board design, combined with Ladder+ BASIC programming software with an internal clock. Operations software is downloaded into the programmable logic controller (PLC). An Ethernet port may be provided that can connect to other devices or web servers for control or data up/down loading.

The controller 175 will include a differential pressure transducer. The transducer generates an electrical signal. The signal is digitized and processed by the PLC 175 and associated circuitry.

The orifice plate 170 is sized to correspond to a predetermined inner diameter of the production tubing 120. Preferably, the orifice plate 170 has a hole that is between 25% and 75% of the inner diameter of the production tubing 120, although 50% is optimal. The differential pressure across the sized orifice plate 170 corresponds to critical flow velocity in the production tubing 120. Thus, the operator or completion company installs a pre-sized orifice plate 170 based on a known inner-diameter of the production tubing 120. If a smaller i.d. production tubing 120 is later installed, then an orifice plate 170 having a correspondingly smaller opening may also be installed.

After passing across the orifice plate 170, the production line extends as line 176. The production line 176 further extends to transport line 180, which may be a line that delivers production fluids to a gathering or processing facility (not shown). The facility may be, for example, a gas sweetening facility. Alternatively, line 180 may be a sales line for immediate downstream delivery where the gas meets pipeline specification standards.

Also shown in FIG. 1A is a second pressure gauge 152. The second pressure gauge 152 measures pressure in the annular region 125. Readings taken by the pressure gauge 152 may also be delivered to the controller 175, such as by means of a wireless signal or an electrical or fiber optic wire (not shown).

The method described in U.S. Pat. No. 5,636,693 was intended for wells that are "tubing limited." This means that the tubing was restrictive to flow. As described in the '693 patent, it was observed that the required differential pressure (for critical flow velocity) stayed constant over the entire flowing pressure range. This led to the selection of a differential pressure controller to control the flow of excess gas up the second flow conduit 125.

A concept that was not described in the '693 patent and not heretofore employed relates to the real-time control of the amount of gas injected into the second flow conduit, that is, the annular region 125. It is desirable to inject a compressible fluid down the annular region 125 (either into the tubing-casing annulus or through a dedicated line) at a rate high enough to maintain the critical flow velocity back up the tubing 120 even as fluid composition and fluid density change over the life of the well 10. This avoids (or at least delays) changing out the production tubing 120 (i.e., installing a smaller i.d. tubing string) and corresponding orifice plate 170.

In practice, particularly in connection with horizontally completed wells, gas injection has been done by the industry through the CGC process as described above. This process is wasteful as it involves the "continuous" injection of gas (and the continuous use of electricity for a compressor) whether the well actually needs it or not. Accordingly, an optimized gas compression system 100A for gas injection is offered herein. Here, the controller 175 controls the rate at which gas is injected into the annular region 125 in substantially real time based upon what the well 10 actually needs to lift reservoir fluids.

In the system 100A of FIG. 1A, a control line 174 is provided. The control line 174 extends from the controller 175 to the motorized control valve 185. The control valve 185 may be, for example, an electrically actuated valve, such as an eccentric disk. The control line 174 may include copper wires that transmit a variable current to adjust a position of the valve 185, or may comprise a data cable that sends command signals to firmware or hardware in the valve 185.

The controller 175 represents a micro-processor having various components (not shown). These may include a printed circuit board, digital inputs (or pins) with a high speed counter, an analog input/output card, and a bus port. The controller 175 may also include an expansion port and digital outputs. Finally, the controller 175 may have an LCD interface and optional display, or may have a transceiver for communicating operating state through a wireless communications network. In this instance, control line 174 represents a wireless signal sent from a remote transmitter through the wireless communications network.

The controller 175 may include a memory module. In one aspect, the memory module is a ferromagnetic random access memory card. The card may be, for example, the FRAM-RTC-256 module from Triangle Research. This card has a set of 2×5 header pins which are plugged into the CONN1 connector on the PLC. The card is able to store data should such be desired for data logging.

The controller 175 may also include an on-off selector switch (not shown). This switch may be, for example, the Automation Direct GCX Series Selector Switch, Model GCX1200. A contact block for the GCX switch will also be included. The selector switch is connected to shielded wires each containing, for example, two 18-gauge conductors.

When in the OFF position, the On-Off switch will keep the controller 175 from operating, and the gas compression optimization system 100 will behave as if there were no control, allowing for a continuous injection of compressible fluid in accordance with the CGC principle. In the ON position, it will allow the controller 175 to control the rate at which the compressible fluid is injected into the annular region 125 in real time. In this way, the controller 175 improves operation of the compression system, conserving electricity and gas while maintaining downhole gas flow at or above critical flow.

Figure 1B:
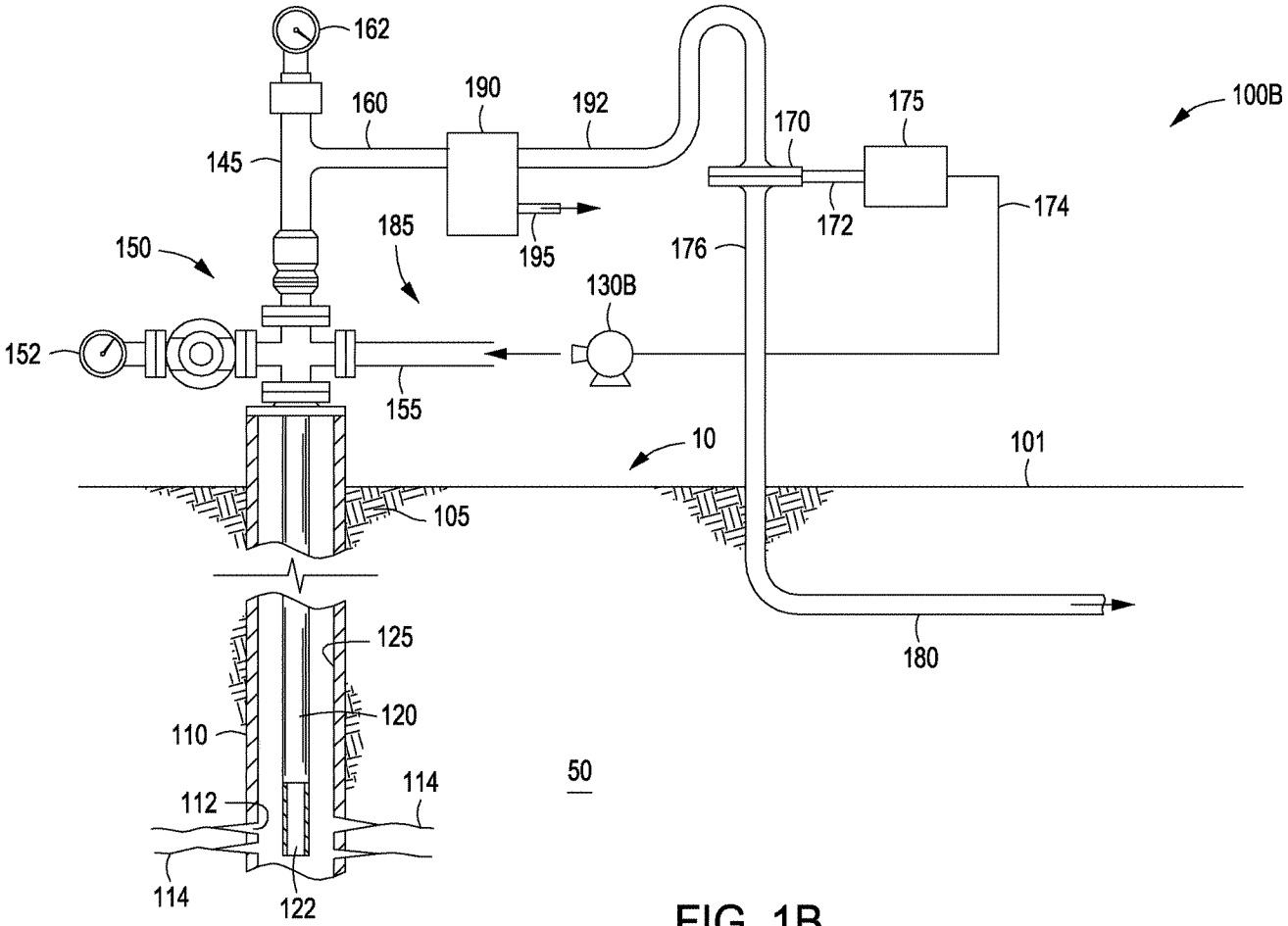
FIG. 1B is a schematic illustration of a gas compression optimization system for a wellbore, in a second embodiment. The gas compression optimization system again controls a rate at which gas is injected into the annular region of a wellbore to support gas lift. In this arrangement, gas injection is supplied by a local gas compressor.

FIG. 1B is a schematic illustration of a gas compression optimization system 100B for a wellbore 10, in a second embodiment. The gas compression optimization system 100B again controls a rate at which gas is injected into the annular region 125 of the wellbore 10 to support gas lift. System 100B is the same as system 100A, except that in this arrangement, gas is supplied by a local gas compressor 130B. The compressor 130B preferably uses gas produced from the formation 50 at the well head 150, or gas supplied through a local storage tank. However, gas may also be sourced from a remote storage tank or remote separator via pipeline.

In order to control the rate at which the compressible fluid is injected into the annular region 125, the controller 175 controls the operation of the compressor 130B. It is observed that in the system 100B, the controller 175 is a differential pressure measurement device which reports to a device that adjusts compressor 130B speed to maintain a desired differential pressure set point. Control line 174 is again shown, which may include copper wires that transmit a variable current to adjust compressor speed. Alternatively, the control line 174 may comprise a data cable that sends command signals to firmware or hardware in the compressor 130B. Alternatively, control line 174 may represent a wireless control signal sent to the compressor 130B to vary pump speed.

In either of systems 100A, 100B, the controller 175 operates to receive pressure readings ("DP") from a differential pressure transducer, and compare those DP readings to a pre-set value or value range, referred to as a set point. The set point is correlated to a critical flow velocity in the production tubing. The controller 175 maintains fluid flow in the production tubing 120 at or above the critical gas velocity in substantially real time by adjusting gas injection rate in response to the differential pressure transducer signals. When fluids flowing through the tubing string 120 exceed the critical velocity set point as indicated by the differential pressure (or DP) readings at the orifice plate 170, the controller 175 reduces the rate of injection. Injection rate may be reduced incrementally according to a pre-set value, or step-down; alternatively, injection rate may be reduced by an amount calculated to achieve a more suitable injection rate to reach critical velocity in real time.

Reciprocally, when fluids flowing through the tubing string 120 fall below the critical velocity set point as indicated by differential pressure readings at the orifice plate 170, the controller 175 increases the rate of injection into the annular region 125. Injection rate may be increased incrementally according to a pre-set value, or step-up; alternatively, injection rate may be increased by an amount calculated to achieve a more suitable injection rate to reach critical velocity in real time. In either instance, this serves to maintain fluid flow in the production tubing 120 during production at (or just above) a critical gas flow rate.

As can be seen, improved gas compression optimization systems are offered. Using the systems, a method of optimizing gas injection rate for a gas lift system may be provided.

Figure 2A:
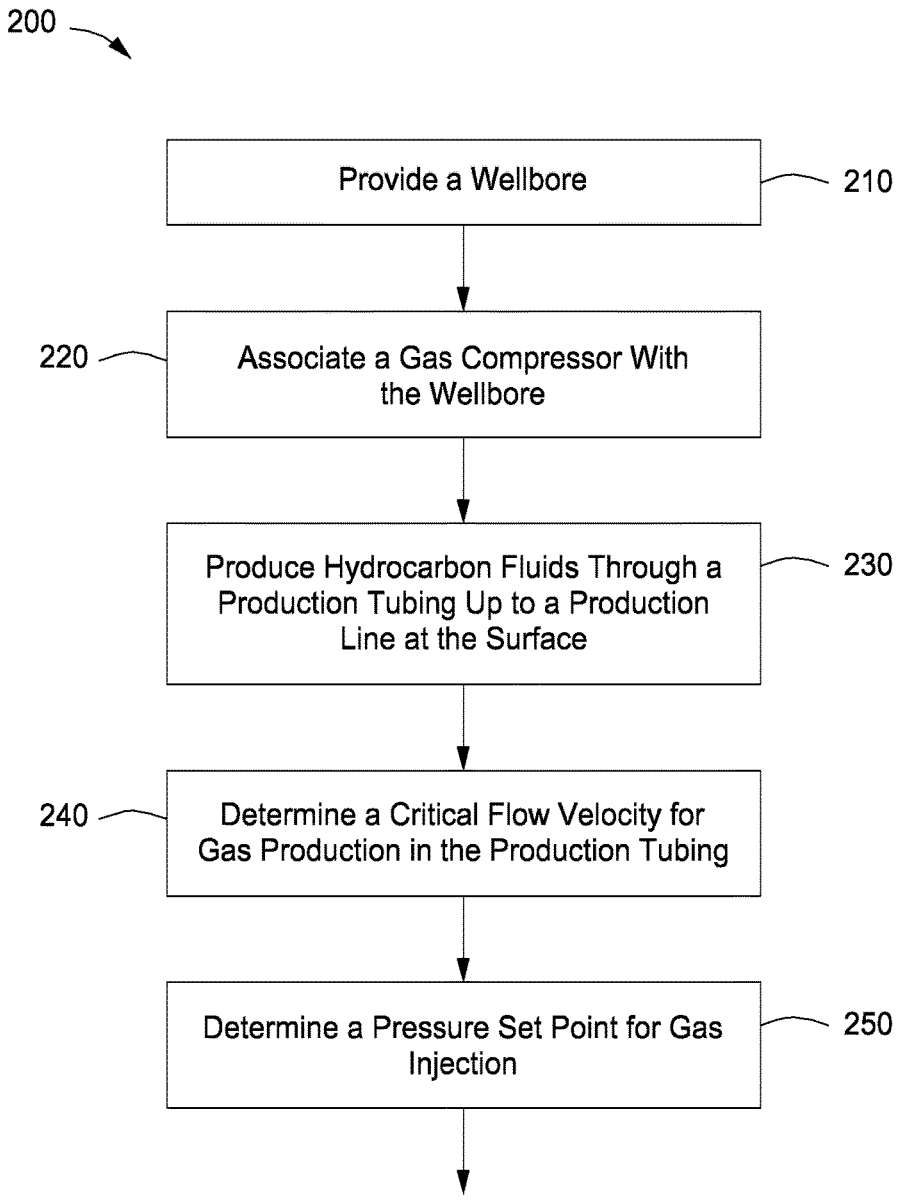
FIGS. 2A and 2B present a single flow chart for steps used in optimizing a gas injection rate, using a gas compression optimization system.
Figure 2B:
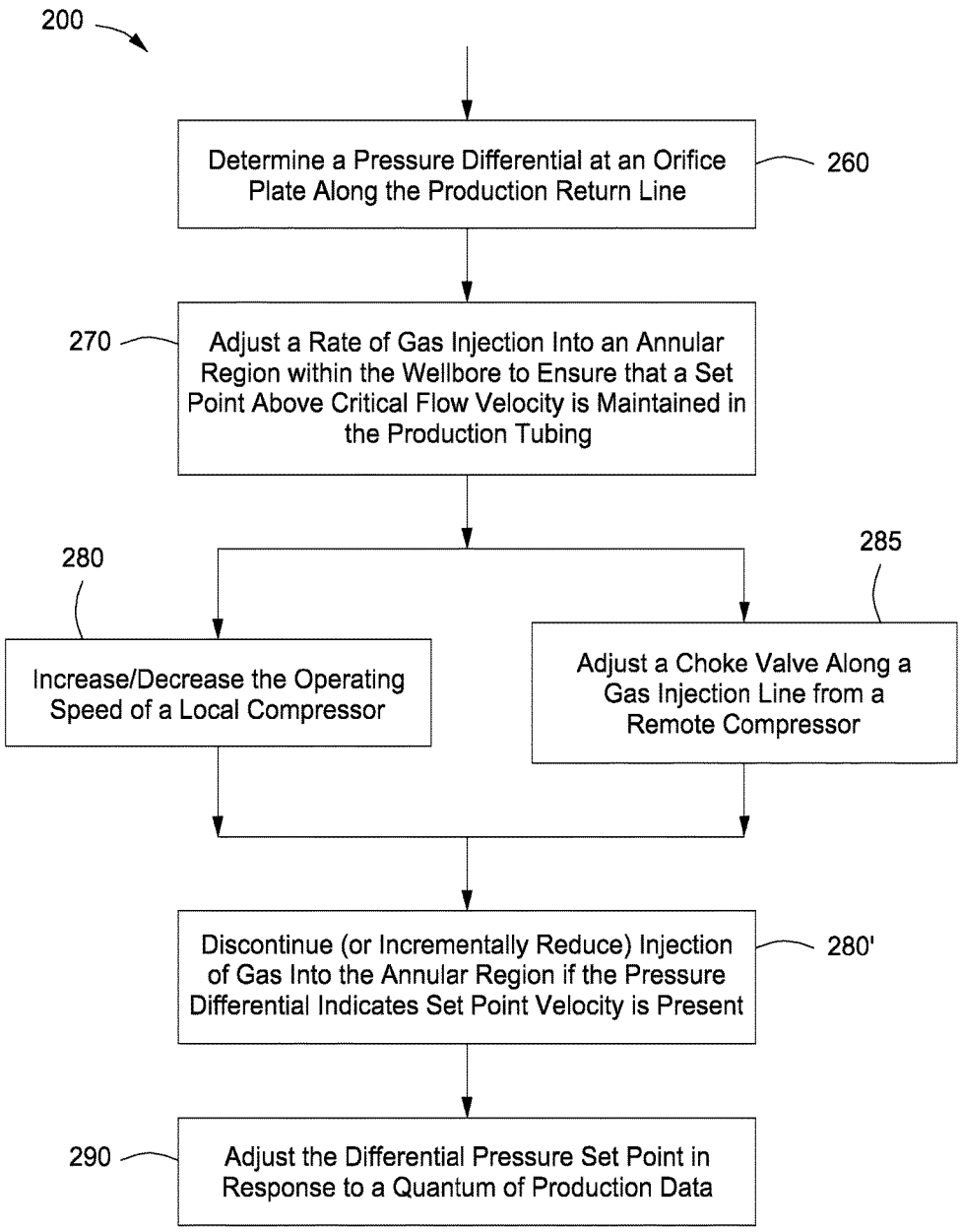

FIGS. 2A and 2B present a single flow chart for steps used for a method 200 of optimizing gas injection rate, using a gas compression optimization system. The gas optimization system may be in accordance with any of the systems described above, such as systems 100A and 100B.

The method 200 first includes providing a wellbore. This is shown in FIG. 2A at Box 210. The wellbore has been formed for the purpose of producing hydrocarbon fluids to the surface in commercially viable quantities. Preferably, the well primarily produces hydrocarbon fluids that are compressible at surface conditions, e.g., methane, ethane, propane and/or butane. In one aspect, the wellbore has been completed horizontally. In this instance, the gas optimization system may be offered to help overcome a problem of slug flow along the horizontal leg of the wellbore.

The method 200 next includes associating a gas compressor with the wellbore. This is provided at Box 220. The gas compressor may be an on-site compressor such as compressor 130B; alternatively, the gas compressor may be a remote compressor that supplies gas to a plurality of wells in a field, such as compressor 130A. In either instance, the gas compressor is associated with the wellbore through a gas injection line such as line 155.

The method 200 also includes producing hydrocarbon fluids through a production tubing, and up to a production line at the surface. This is indicated at Box 230. An annular region is formed between the production tubing and a surrounding casing string. The annular region may be open, or may represent a dedicated flow tube in the annulus.

The method 200 next comprises determining a critical flow velocity for gas production in the production tubing. This is seen at Box 240. This is the flow velocity for gas needed to carry entrained liquid particles to the surface. The critical flow velocity is a function primarily of production tubing pressure and production tubing diameter. However, fluid composition and formation pressure are also considerations.

The method 200 further includes determining a set point for gas injection. This is provided at Box 250. The set point represents a point at which a rate of gas injection is adjusted in order to maintain the desired critical flow velocity. The set point is preferably measured in terms of pressure. It is understood that gas velocity is correlated to the pressure set point based on factors such as tubing diameter, fluid composition and fluid density. Fluid composition and fluid density are known quantities, enabling the operator to readily correlate tubing diameter with the desired orifice plate restriction. The set point, in turn, is based on the size of the orifice plate 170.

In the present disclosure, the gas compression system is constructed with the orifice plate 170 tuned to the inner diameter of the production tubing 120. As noted, the set point is based on the size of the orifice plate 170. If a small orifice plate is used, then the set point will need to be increased due to the larger differential pressure created by the smaller hole. In one aspect, the orifice plate opening is one-half the inner diameter of the tubing string 120.

The method additionally includes determining differential pressure (or "DP") at an orifice plate 170 along the production line 135. This is shown at Box 260 in FIG. 2B. Differential pressure is measured by comparing upstream and downstream pressures across the orifice plate 170. This is preferably done through a differential pressure transducer that converts pressure measurements (or differential pressure measurements) into electrical signals. Differential pressure measurements are taken periodically, such as every 5 seconds or every 1 minute. Such measurements are indicative of actual flow velocity occurring in the production tubing. The higher the DP value, the greater the rate of fluid flow in the well.

As part of the step 260 of determining a differential pressure, the DP measurement is compared to the differential pressure set point of step 250. In one aspect, the DP measurement is compared to a DP dead band, or range around the set point. The DP dead band may be, for example, plus or minus 2 inches, or plus or minus 5 inches, of the set point (normally measured in inches of water column).

The method 200 then includes adjusting a rate of gas injection into the annular region 125 to ensure that a gas flow rate at or just above a pre-determined critical flow velocity is maintained in the production tubing 120. If an on-site compressor is used, then the step will include adjusting the compressor speed. This is shown at Box 280. This may include increasing the compressor speed when the DP measurement is below the set point or, alternatively, below a DP dead band, or reducing the compressor speed when the DP measurement is above the set point or, alternatively, above a DP dead band.

Ideally, flow rate adjustments are made incrementally, such as in 2 inch increments. However, in one aspect, the speed change is proportional to how far the DP measurement suggests actual gas flow velocity is from the set point. It is observed that the critical rate changes in proportion to the square root of tubing pressure.

Of interest, where the desired compressor speed falls appreciably below the minimum operating speed of the compressor, then the method 200 will further include the step of bypassing the compressor. For example, if the controller sees that five consecutive differential pressure measurements are above the set point, indicating that reservoir pressure is efficiently driving formation fluids up the wellbore, then the controller may be incrementally reducing compressor speed below a minimum operating speed. It is understood that most compressors have a minimum RPM that is typically at 50% of rated RPM. If the compressor 130A or 130B has a controller-actuated bypass valve, then the suction pressure and the output pressure of the compressor will be the same, consuming a pittance of electricity. In this instance, gas is just circulated at the compressor without injection.

If a remote, central compressor is used, then the method 200 will include choking gas being delivered to the wellbore. This is provided at Box 285. If, for example, the controller sees that five consecutive differential pressure measurements are above the set point, indicating that reservoir pressure is efficiently driving formation fluids up the wellbore, then the controller may ultimately completely choke off flow through the valve and the valve will no longer apply force to cause further closure.

The method 200 further includes discontinuing the injection of gas into the annular region if a DP measurement indicates critical flow velocity is present in the production tubing. This is provided at Box 280'. In one aspect, the step 280' means discontinuing the injection of gas into the annular region 125 if the DP measurement is above the set point. This is related to the steps of Boxes 280 and 285.

The method 200 may optionally further provide periodically adjusting the differential pressure set point. This is shown in Box 290. The adjusting step of Box 290 is done in response to a set of production data provided over a given period of time. Preferably, the adjustment step of Box 290 is done every 24 hours.

Figure 3:
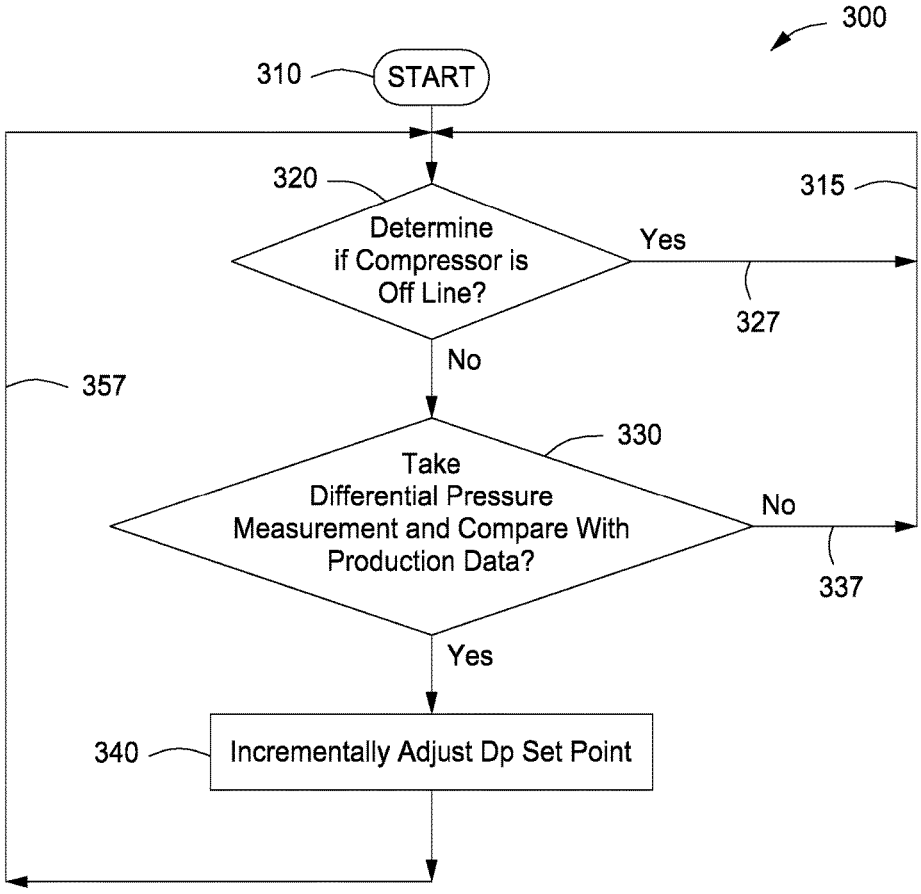
FIG. 3 is a second flow chart presenting steps associated with iteratively adjusting a differential pressure set point based on a quantum of production data.

FIG. 3 is a second flow chart presenting the adjustment step of Box 290, in greater detail. This is shown through a more detailed series of steps 300 that are associated with a controller that may be part of the gas compression optimization system in its various embodiments. More specifically, the steps 300 demonstrate operation of the controller in adjusting the differential pressure set point based on a quantum of measured production data as provided in Box 290. Preferably, the adjustment is made once a day or, alternatively, once every 12 hours.

The method 300 first shows a start point. This is indicated at Block 310. The start point 310 operates in conjunction with a timer associated with the controller (or micro-processor). The timer will activate the controller to carry out the DP set point adjustment method 300.

The method 300 next provides for determining if the compressor has been taken off-line. This is indicated at Query 320. A compressor may be taken off-line for workover of the well or for maintenance of the compressor itself. A compressor may be "ESD'd", meaning "emergency shutdown," in the event of a catastrophic failure in the gas line or the wellhead, or if a measured threshold is exceeded. If the compressor is off-line, no attempt is made to adjust DP set point and the routine moves back to the Start Block 310 according to Lines 327 and 315.

If the compressor is on-line, the method 300 next includes determining the relationship between a differential pressure measurement at an orifice plate and a pre-determined critical gas velocity. This is provided at Query 330. In one aspect, the differential pressure measurement is an average DP value taken over a preceding 24 hour period or, alternatively, a preceding 12 hour period or, more preferably, a preceding 4 hour period.

If, after 24 hours of operation the net hydrocarbon production, or other production indicator, after subtracting the injection volume, has not appreciably changed, then the controller may iteratively increase the pressure set point by one inch or, alternatively, by two inches. If the net hydrocarbon production the next day is higher, then the controller may again increase the set point by one inch or, alternatively, by two inches. On the other hand, if the net hydrocarbon production volume did not increase, then the controller may iteratively drop the set point back down by one inch or, alternatively, by 2 inches. When an adjustment of DP set point is made, the method 300 returns to the Start Block 310 via Lines 337 and 315. The controller may incrementally decrease the differential pressure set point over consecutive designated periods of time until the wellbore begins to lose net hydrocarbon production, in which case a direction of differential pressure set point change is reversed so as to auto-tune gas injection. In this way, the differential pressure set point is adjusted in somewhat real time in response to changes in the wellbore production.

If no adjustment of DP set point is made in step 340, this value will be utilized in the next iteration of step 250, and saved for use in the next cycle of the method 300. The method 300 then returns to the Start Block 310 via Line 357.

As can be seen, a gas compression optimization system is provided. The system is ideal for wells having a high GOR, such as 4,000 or greater, but also functions for wells with low GOR, such as 500. The system is also ideal for wells that are completed horizontally. Those of ordinary skill in the art will recognize that horizontal wells have a tendency to experience slugging. As gas invades the horizontal leg of a wellbore, the gas will build up along an upper surface of the casing. As pressure within the horizontal leg increases due to the build-up of gas, the gas will be released together as a "slug." This creates a period at which critical flow velocity is reached and no gas injection is needed. This slugging phenomenon repeats itself cyclically over the course of a 24 hour period, presenting repeated instances where no gas injection (or substantially reduced gas injection) is needed.

Further, variations of the method for optimizing gas injection rate may fall within the spirit of the claims, below. It will be appreciated that the inventions are susceptible to modification, variation and change without departing from the spirit thereof.

I claim:

1. A gas compression optimization system for a wellbore, comprising:

a tubing string placed in a wellbore, the tubing string extending from a surface down to a selected subsurface formation;

an annular region residing around the tubing string, the annular region also extending down into the wellbore and to the subsurface formation;

a production line at the surface and in fluid communication with the tubing string;

an orifice plate at the surface and residing along the production line, the orifice plate having an opening that is sized relative to an inner diameter of the tubing string;

a pressure transducer configured to determine differential pressure across the orifice plate, wherein the differential pressure is correlated to a pre-determined critical gas velocity in the tubing string;

a gas injection line also at the surface configured to inject a compressible fluid into the annular region; and a controller configured to receive differential pressure value signals "DP" from the pressure transducer, determine whether "DP" is above or below a differential pressure set point and, in response, to control a rate of injection of the compressible fluid into the annular region to maintain fluid flow in the tubing string at a rate that provides critical gas velocity, in real time.

2. The gas compression optimization system of claim 1, wherein:

the set point is a defined value or a dead band about a defined value; and the set point is correlated to the pre-determined critical gas velocity.

3. The gas compression optimization system of claim 2, wherein the orifice plate comprises an opening having an inner diameter that is one-half of an inner diameter of the tubing string.

4. The gas compression optimization system of claim 2, further comprising:

a compressor configured to pump the compressible fluid into the gas injection line.

5. The gas compression optimization system of claim 4, wherein:

the compressor is a dedicated variable speed compressor that resides at a well site for the wellbore; and the controller is configured to send command signals to the compressor to adjust an operational speed to control the rate of injection of the compressible fluid.

6. The gas compression optimization system of claim 5, wherein:

the controller is configured to incrementally reduce operating speed of the compressor when a differential pressure value signal is above the dead band; and the controller is further configured to incrementally increase operating speed of the compressor when a differential pressure value signal is below the dead band.

7. The gas compression optimization system of claim 5, wherein:

the controller is configured to reduce operating speed of the compressor by an amount proportional to how far the differential pressure value signal suggests actual gas flow velocity is above the set point; and the controller is configured to increase operating speed of the compressor by an amount proportional to how far the differential pressure value signal suggests actual gas flow velocity is below the set point.

8. The gas compression optimization system of claim 6, wherein:

the controller makes no adjustment of operating speed of the compressor where the differential pressure reading is within the dead band about the set point.

9. The gas compression optimization system of claim 4, wherein:

the compressor is a facilities compressor that resides remote from a well site for the wellbore and is configured to deliver gas to a plurality of gas service lines;

the system further comprises a control valve; and the controller is configured to send command signals to the control valve to adjust a flow of fluids through the gas injection line associated with a service line to control the rate of injection of the compressible fluid.

10. The gas compression optimization system of claim 9, wherein:

the controller is configured to incrementally reduce gas flow through the control valve when a differential pressure value signal is above a dead band set point; and the controller is further configured to incrementally increase gas flow through the control valve when a differential pressure value signal is below a dead band set point.

11. The gas compression optimization system of claim 9, wherein the controller is configured to:

reduce gas flow through the control valve by an amount proportional to how far the differential pressure value signal suggests actual gas flow velocity is above the set point; and increase gas flow through the control valve by an amount proportional to how far the differential pressure value signal suggests actual gas flow velocity is below the set point.

12. The gas compression optimization system of claim 1, wherein the annular region is (i) a generally cylindrical space defined between the tubing string and a surrounding string of casing, (ii) an injection line residing within the wellbore and along the tubing string, or (iii) a combination thereof.

13. The gas compression optimization system of claim 1, wherein the controller is configured to receive data indicative of hydrocarbon production from the wellbore over a designated period of time, and adjust the differential pressure set point in response to the data in order to tune the differential pressure set point to changes in wellbore production.

14. The gas compression optimization system of claim 13, wherein the controller is further configured to (i) confirm that the wellbore has been operating at a steady state condition over the designated period of time and, (ii) if the wellbore has in fact been operating at a steady state condition over the designated period of time, adjust the differential pressure set point upward when the net hydrocarbon production has increased over the designated period, and adjust the differential pressure set point downward when the net hydrocarbon production has decreased over the designated period.

15. The gas compression optimization system of claim 13, wherein:

the designated period of time is no longer than 24 hours; and the controller is further configured to adjust the differential pressure set point based upon a response of the wellbore to a last differential pressure set point change in maintaining or increasing net hydrocarbon production, wherein the differential pressure set point is incrementally increased as net hydrocarbon production increases over consecutive designated periods of time, the differential pressure set point is incrementally decreased as net hydrocarbon production continues to increase over consecutive designated periods of time until net hydrocarbon production no longer increases, in which case a direction of differential pressure set point change is reversed so as to auto-tune gas injection.

16. A method of optimizing a gas injection rate for an artificial lift system, comprising:

providing a wellbore, the wellbore having a string of production tubing extending from a surface down into the wellbore;

determining an inner diameter of the production tubing;

providing an orifice plate along a production line at the surface, wherein the production line is in fluid communication with the production tubing;

associating a gas compressor with the wellbore;

producing hydrocarbon fluids through the production tubing in the wellbore, and up to the production line at the surface;

determining a critical flow velocity for gas production in the production tubing;

determining a pressure differential across the orifice plate, the pressure differential being indicative of flow rate in the production tubing;

sizing an opening for the orifice plate relative to the determined inner diameter of the production tubing;

comparing the pressure differential as a value signal to a pre-determined "DP" set point that correlates to the determined critical flow velocity; and adjusting a rate of gas injection into an annular region in the wellbore to ensure that critical flow velocity is achieved in the production tubing, in real time.

17. The method of claim 16, wherein the wellbore is completed vertically.

18. The method of claim 16, wherein the wellbore is completed substantially horizontally.

19. The method of claim 16, wherein the annular region defines (i) a tubing-casing annulus, (ii) an injection line residing within the wellbore and along the tubing string, or (iii) a combination thereof.

20. The method of claim 16, wherein:

the pre-determined DP set point is a numerical value, or a dead band about a numerical value; and the DP set point is correlated to the pre-determined critical flow velocity.

21. The method of claim 20, wherein the orifice plate comprises an opening having an inner diameter that is one-half of an inner diameter of the production tubing.

22. The method of claim 20, further comprising:

discontinuing the injection of gas into the annular region when the gas flow velocity in the production tubing remains above the DP set point after at least 4 readings taken over a 24 hour period.

23. The method of claim 20, wherein:

the gas compressor is an on-site variable speed compressor; and the step of adjusting a rate of gas injection comprises sending a control signal from a micro-processor to the compressor, the micro-processor being configured to send control signals to the compressor to adjust an operational speed so as to control the rate of gas injection into the annular region.

24. The method of claim 20, wherein:

the controller is configured to incrementally reduce operating speed of the compressor when a differential pressure value signal is above the DP dead band; and the controller is further configured to incrementally increase operating speed of the compressor when a differential pressure value signal is below the DP dead band.

25. The method of claim 20, wherein:

the controller is configured to reduce operating speed of the compressor by an amount proportional to how far the differential pressure value signal suggests actual gas flow velocity is above the DP set point; and the controller is configured to increase operating speed of the compressor by an amount proportional to how far the differential pressure value signal suggest actual gas flow velocity is below the DP set point.

26. The method of claim 20, wherein:

the controller makes no adjustment of operating speed of the compressor where the differential pressure reading is within the dead band about the DP set point.

27. The method of claim 20, wherein:

the gas compressor is a remote facilities compressor that injects gas into a plurality of gas service lines; and the step of adjusting a rate of gas injection comprises sending a control signal from a micro-processor to adjust a position of control valve in a gas service line so as to control the rate of gas injection into the annular region.

28. The method of claim 27, wherein:

the controller is configured to incrementally reduce gas flow through the control valve when a differential pressure value signal is above the dead band about the DP set point; and the controller is further configured to incrementally increase gas flow through the control valve when a differential pressure value signal is below the dead band about the DP set point.

29. The method of claim 27, wherein:

the controller is configured to reduce gas flow through the control valve by an amount proportional to how far the differential pressure value signal suggests actual gas flow velocity is above the DP set point; and the controller is configured to increase gas flow through the control valve by an amount proportional to how far the differential pressure value signal suggest actual gas flow velocity is below the DP set point.

30. The method of claim 20, further comprising:

adjusting the DP set point for gas injection.

31. The method of claim 30, wherein adjusting the DP set point is done automatically in response to a quantum of production data, thereby tuning the DP set point.

32. The method of claim 20, further comprising:

receiving data indicative of hydrocarbon production from the wellbore over a designated period of time, and adjusting the DP set point in response to the data in order to tune the differential pressure set point to changes in wellbore production.

33. The method of claim 32, wherein:

the designated period of time is no longer than once per day; and the method further comprises:

calculating a volume of net hydrocarbon production from the wellbore over the designated period of time; and adjusting the DP set point based upon a response of the wellbore to a last DP set point change in maintaining or increasing net hydrocarbon production, wherein the differential pressure set point is incrementally increased as net hydrocarbon production increases over consecutive designated periods of time, the differential pressure set point is incrementally decreased as net hydrocarbon production continues to increase over consecutive designated periods of time until net hydrocarbon production no longer increases, in which case a direction of differential pressure set point change is reversed so as to auto-tune gas injection.

34. The method of claim 32, wherein the controller is configured to (i) confirm that the wellbore has been operating at a steady state condition over the designated period of time and, (ii) if the wellbore has in fact been operating at a steady state condition over the designated period of time, adjust the DP set point upward when the net hydrocarbon production has increased over the designated period, and adjust the DP set point downward when the net hydrocarbon production has decreased over the designated period.

35. The method of claim 16, wherein adjusting a rate of gas injection into an annular region in the wellbore comprises sending a control signal to a variable speed compressor or to a control valve from a micro-controller proximate the wellbore.

36. The method of claim 16, wherein adjusting a rate of gas injection into an annular region in the wellbore comprises sending a control signal to a variable speed compressor or to a control valve from a computer by means of a wireless signal.

37. A gas compression optimization system for a wellbore, comprising:

a tubing string placed in a wellbore, the tubing string extending from a surface down to a selected subsurface formation;

an annular region residing around the tubing string, the annular region also extending down into the wellbore and to the subsurface formation;

a production line at the surface and in fluid communication with the tubing string;

an orifice plate at the surface and residing along the production line, the orifice plate having an opening that is sized relative to an inner diameter of the tubing string;

a pressure transducer configured to determine differential pressure across the orifice plate, wherein the differential pressure is correlated to a gas velocity in the tubing string;

a gas injection line also at the surface configured to inject a compressible fluid into the annular region; and a controller configured to receive the differential pressure value signals "DP" from the pressure transducer, determine whether "DP" is above or below a differential pressure set point correlated to a critical gas velocity value and, in response, control a rate of injection of the compressible fluid into the annular region to maintain fluid flow in the tubing string at a rate that provides critical gas velocity, in real time;

and wherein the controller is configured to:

reduce gas flow through the control valve by an amount proportional to how far the differential pressure value signal suggests actual gas flow velocity is above the set point; and increase gas flow through the control valve by an amount proportional to how far the differential pressure value signal suggests actual gas flow velocity is below the set point.

38. The gas compression optimization system of claim 37, wherein controlling a rate of injection of the compressible fluid comprises adjusting a rate of gas injection into an annular region in the wellbore by sending a control signal to a variable speed compressor or to a control valve from a micro-controller.

39. The gas compression optimization system of claim 37, wherein controlling a rate of injection of the compressible fluid comprises adjusting a rate of gas injection into the annular region in the wellbore by sending a control signal to a variable speed compressor or to a control valve from a computer by means of a wireless signal.

* * * * *